US007780490B2

(12) United States Patent
Lundgren

(10) Patent No.: US 7,780,490 B2
(45) Date of Patent: Aug. 24, 2010

(54) WATERCRAFT WITH CONTROL SYSTEM FOR CONTROLLING WAKE AND METHOD FOR CONTROLLING WAKE

(75) Inventor: Kent Lundgren, Chesapeake, VA (US)

(73) Assignee: AB Volvo Penla, Göteborg (SE)

( * ) Notice: Subject to any disclaimer, the term of this patent is extended or adjusted under 35 U.S.C. 154(b) by 17 days.

(21) Appl. No.: 12/211,218

(22) Filed: Sep. 16, 2008

(65) Prior Publication Data

US 2010/0068950 A1 Mar. 18, 2010

(51) Int. Cl.
*B63H 21/22* (2006.01)

(52) U.S. Cl. ..... 440/1; 701/21

(58) Field of Classification Search ..... 114/144 A, 114/144 R; 440/1, 53, 84, 87; 701/21
See application file for complete search history.

(56) References Cited

U.S. PATENT DOCUMENTS

| | | | | |
|---|---|---|---|---|
| 5,860,384 | A | 1/1999 | Castillo | |
| 5,867,932 | A | 2/1999 | Reiger | |
| 6,012,408 | A | 1/2000 | Castillo | |
| 6,082,670 | A | 7/2000 | Chapman | |
| 6,935,263 | B1 | 8/2005 | Bandyopadhyay | |
| 6,994,046 | B2 * | 2/2006 | Kaji et al. | 114/144 R |
| 7,192,322 | B2 | 3/2007 | Grzonka et al. | |
| 7,252,047 | B1 | 8/2007 | Baucom, Jr. | |
| 7,267,068 | B2 * | 9/2007 | Bradley et al. | 114/144 R |
| 7,371,140 | B2 * | 5/2008 | Davis | 440/53 |
| 7,416,458 | B2 * | 8/2008 | Suemori et al. | 440/53 |
| 7,429,202 | B2 * | 9/2008 | Yazaki et al. | 440/53 |
| 7,467,595 | B1 * | 12/2008 | Lanyi et al. | 114/144 R |
| 7,677,937 | B2 * | 3/2010 | Ishida et al. | 440/1 |
| 2008/0096447 | A1 | 4/2008 | De Masi | |
| 2008/0171479 | A1 * | 7/2008 | Hallenstvedt et al. | 440/1 |
| 2009/0004930 | A1 * | 1/2009 | Larsson | 440/1 |
| 2009/0197486 | A1 * | 8/2009 | Szilagyi et al. | 440/53 |

FOREIGN PATENT DOCUMENTS

| | | | |
|---|---|---|---|
| RU | 2142894 | C1 | 12/1999 |
| WO | 2007105995 | A1 | 9/2007 |
| WO | 2007105997 | A1 | 9/2007 |

* cited by examiner

*Primary Examiner*—Lars A Olson
(74) *Attorney, Agent, or Firm*—WRB-IP LLP

(57) ABSTRACT

A watercraft with a control system includes at least two propulsion units carried by a hull of the watercraft. Each propulsion unit is independently turnable. The watercraft includes a control system arranged to control orientation of the propulsion units. The control system includes a first control mode in which turning of two of the propulsion units is limited to turning through less than an entire range of motion of the two propulsion units, in equal amounts, and in opposite directions relative to a longitudinal centerline of the watercraft.

15 Claims, 1 Drawing Sheet

WATERCRAFT WITH CONTROL SYSTEM FOR CONTROLLING WAKE AND METHOD FOR CONTROLLING WAKE

BACKGROUND AND SUMMARY

The present invention relates generally to controlling watercraft wake and, more particularly, to controlling wake from watercraft having plural propulsion units.

As explained in U.S. Pat. No. 5,867,932, fishing with a lure or live bait using the trolling method involves dropping or casting the lure or bait into a body of water, with the lure or bait being connected to a moving watercraft by means of a thin fishing line which pulls the lure or bait through the water. This pulling motion of the lure through the water causes the lure to engage in commonly used oscillations intended to attract the attention of fish within the water. One known method of dropping or casting a fishing line for trolling is to simply extend, by hand, one or more commercially available fishing rods over the water from a moving watercraft so that the bait or lure is placed in the water, and then allowing the fishing line to unwind from the reel. Another known method, used more frequently within the commercial fishing industry, is to use long fiberglass poles and outriggers which spread multiple lines behind the boat to avoid tangling. Due to the forward motion of a watercraft while trolling, a fishing line dropped or cast from the watercraft will tend to migrate toward the back, or wake, of the watercraft and remain there. However, it is undesirable for a fishing line to remain directly behind the watercraft while trolling because a moving watercraft generally has some means of propeller propulsion, which, in addition to the exhaust from a driving engine, creates a wake or path behind the watercraft. This wake or path directly behind the watercraft is generally significantly turbulent and not conducive to the normal oscillating motion of a fishing lure or live bait. In addition, fish are known to avoid engine exhaust and propeller wakes.

It is desirable to control the wake of a watercraft, particularly so that the wake minimizes interference with trolling.

In accordance with an aspect of the present invention, a watercraft with a control system comprises at least two propulsion units carried by a hull of the watercraft, each propulsion unit being independently turnable, and a control system arranged to control orientation of the propulsion units, the control system including a first control mode in which turning of two of the propulsion units is limited to turning through less than an entire range of motion of the two propulsion units, in equal amounts, and in opposite directions relative to a longitudinal centerline of the watercraft.

In accordance with another aspect of the present invention, a control system for a watercraft is provided, the watercraft comprising at least two, independently turnable propulsion units carried by a hull of the watercraft. The control system comprises a program fixed on a medium, the program being arranged to operate the propulsion units in a first control mode so that turning of two of the propulsion units is limited to turning through less than an entire range of motion of the two propulsion units, in equal amounts, and in opposite directions relative to a longitudinal centerline of the watercraft.

In accordance with yet another aspect of the present invention, a method of operating a watercraft is provided, the watercraft comprising at least two, independently turnable propulsion units carried by a hull of the watercraft. According to the method the watercraft is operated in a first control mode in which turning of two of the propulsion units is limited to turning through less than an entire range of motion of the two propulsion units, in equal amounts, and in opposite directions relative to a longitudinal centerline of the watercraft. In another step of the method, the watercraft is operated in a second control mode different from the first control mode.

BRIEF DESCRIPTION OF THE DRAWINGS

The features and advantages of the present invention are well understood by reading the following detailed description in conjunction with the drawing in which like numerals indicate similar elements and in which.

DETAILED DESCRIPTION

Figure 1:
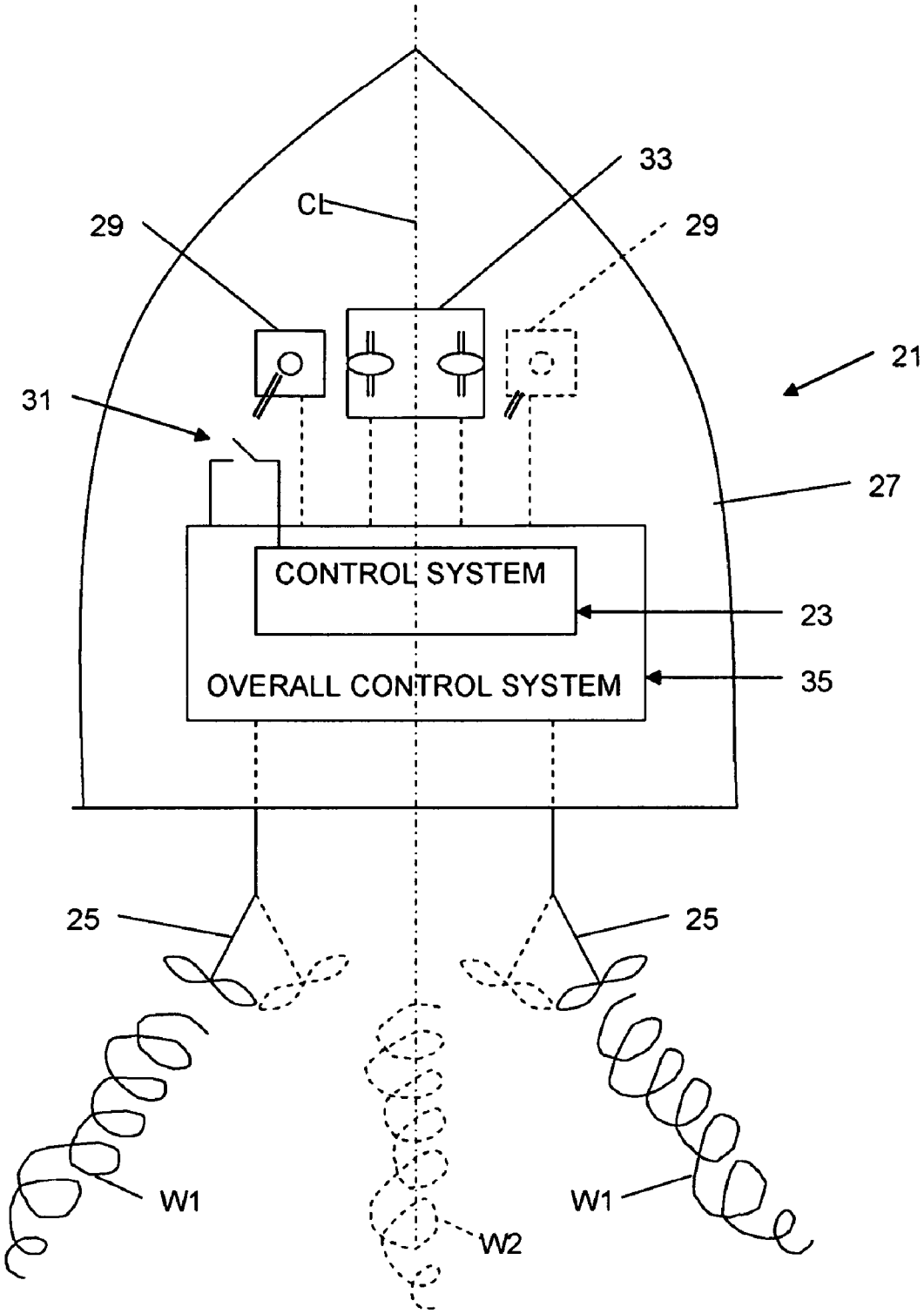
FIG. 1 schematically shows a watercraft with a control system according to an aspect of the present invention.

A watercraft 21 with a control system 23 according to an aspect of the present invention is shown in FIG. 1. The watercraft 21 comprises at least two propulsion units 25 carried by a hull 27 of the watercraft. Each propulsion unit 25 is independently turnable. The present invention is considered to be applicable to watercraft of all type, however, it is considered to be particularly useful in connection with watercraft of the type commonly used for sport fishing. The propulsion units 25 can be of any type, as well, however, it is presently contemplated that the present invention will be particularly useful in connection with propulsion units such as stern drives, outboard drives, outboard engines, and "pod" type drive systems. The propulsion units 25 can be turnable through 360° or through a smaller range of motion.

The control system 23 is arranged to control orientation of the propulsion units 25. The control system 23 includes a first control mode in which turning of two of the propulsion units 25, typically at least the outer two propulsion units if more than two propulsion units are provided on the watercraft, is limited to turning through less than an entire range of motion of the two propulsion units, in equal amounts, and in opposite directions relative to a longitudinal centerline CL of the watercraft.

The control system 23 can be a conventional overall electronic vessel control system 35, or part thereof, or it can be separate from and arranged to interact with a preexisting electronic vessel control system, such as where the control system is retrofitted on a preexisting watercraft. The control system 23 may comprise a program fixed on a medium such as a microprocessor, computer, or ECU, the program being arranged to operate the propulsion units in a first control mode so that turning of two of the propulsion units is limited to turning through less than an entire range of motion of the two propulsion units, in equal amounts, and in opposite directions relative to a longitudinal centerline of the watercraft. For purposes of discussion, the control system 23 for operating the watercraft in the first control mode will be treated as a separable subcomponent of an overall control system 35, it being understood that the control system 23 may be an integral part of the overall control system or completely separable therefrom.

It is presently contemplated that, for most watercraft, when operating in the first control mode it will be desirable to limit turning of the propulsion units to about ±10°, and possibly to a smaller amount, such as ±5°, from the longitudinal centerline CL of the watercraft, it being understood that the specific range limit optimal for different watercraft may vary. Orientation of the propulsion units 25 so that they are turned away from the longitudinal centerline of the vessel is occasionally referred to as "toeing out" (shown in solid lines in FIG. 1), and orientation toward the longitudinal centerline is occasionally referred to as "toeing in" (shown in phantom in FIG. 1). By toeing out the two propulsion units 25, and, ordinarily, shutting down any other propulsion units, the wake pattern W1 (shown in solid lines in FIG. 1) following the watercraft 21 can be directed out toward the sides of the watercraft, thereby minimizing disturbances immediately behind the vessel and facilitating trolling behind the watercraft. By toeing in the two propulsion units 25, and, ordinarily, shutting down any other propulsion units, the wake pattern W2 (shown in phantom in FIG. 1) following the watercraft 21 can be limited substantially to a line directly in back of the watercraft, facilitating trolling to the sides of the watercraft.

The watercraft 21 will ordinarily be provided with operator controls 29 such as a steering wheel or wheels, or a joystick or joysticks, for controlling turning of the two propulsion units 25. Operator controls 29 for the propulsion units 25 may include separate controls for each propulsion unit, or a single operator control in conjunction with a control system comprising separate control units for each propulsion unit such as are disclosed in WO2007/105995 or WO2007/105997, which are incorporated herein by reference.

The operator controls 29 can be adapted to control turning of the propulsion units 25 through less than the entire range of motion of the propulsion units, in equal amounts, and in opposite directions from the longitudinal centerline CL of the watercraft when the control system 23 is in the first control mode. In other words, an operator may control positioning of the propulsion units 25 within the limited range of motion permitted by the control system in the first control mode, such as by toeing in or toeing out the propulsion units to provide a wake in a desired location relative to the watercraft, or by selecting the degree of toeing in or toeing out the propulsion units. Alternatively, the control system 23 can be arranged such that, when the control system is in the first control mode, the operator controls for controlling turning of the propulsion units 25 are deactivated and the propulsion units are automatically set in one or more predetermined toed in or toed out orientations.

An operator control, which may be part of the operator control 29 for the orientation of the propulsion units 25, can be provided for switching the control system 23 to the first control mode from another operating mode different from the first control mode, e.g., a normal operation mode in which the propulsion units can be positioned at any position within their possible range of motion. It is presently contemplated that the operator control for switching the control system 23 to the first control mode will be in the form of a switch 31. The switch 31 may be implemented in any number of suitable ways, such as by providing a separate hardware component wired into the control system 23 for switching the control system to the first control mode by means of moving a lever, turning a knob, or pressing a button, or by providing software that automatically switches to the first control mode upon some other operator input, such as by manipulating a steering wheel or a joystick forming the operator control 29 for orientation of the propulsion units in a particular fashion, such as by pressing it in to close or open a circuit, for a length of time.

An operator control can also be provided for switching the control system 23 from the first control mode to another operating mode different from the first control mode, e.g., a normal operation mode in which the propulsion units can be positioned at any position within their possible range of motion. The operator control for switching from the first control mode can also be part of the operator control 29 for the orientation of the propulsion units 25. It is presently contemplated that the operator control for switching from the first control mode will be a switch, ordinarily the same switch 31 as for switching to the first control mode but not necessarily. The operator control for switching from the first control mode may be a separate hardware component or software that responds to some operator input on equipment used for other purposes, such as manipulation of a steering wheel or joystick.

For example, upon receipt of a first input signal from the operator control for switching from the first control mode, the control system 23 can automatically switch from the first control mode to another operating mode. It is presently contemplated that it will be useful to automatically switch from the first control mode to a manual control mode in which turning of the propulsion units 25 is controlled via operator input, such as when, during operation in the first control mode, it is recognized that operator input is quickly needed to avoid a hazard. However, upon receipt of a different input signal from the operator control for switching from the first control mode, the control system 23 can be arranged to switch to an automatic control mode in which turning of the propulsion units 25 is controlled by, for example, the overall control system 35, such as by switching to an automatic docking mode that causes lateral movement of the watercraft.

The watercraft 21 ordinarily comprises a power control arrangement 33 permitting independent operator control of propulsion unit power. The power control arrangement 33 can be associated with the operator controls 29 for orientation of the propulsion units 25 and can permit an operator to select a thrust level to be delivered by each propulsion unit. The power control arrangement 33 and the operator controls 29 for orientation of the propulsion units 25 will ordinarily be controllable by an overall control system 35 that processes operator inputs to steer and power the watercraft 21 (such overall control systems are disclosed in WO2007/105995 or WO2007/105997, which are incorporated herein by reference) during normal operation and according to one or more predetermined control modes including the first control mode and possibly including other control modes for docking and other maneuvers. Further operator controls (not shown) can be provided to override the overall control system 35. When the control system 23 is in the first control mode, the control system 23 can prevent operator control of the propulsion unit power. Alternatively, operator control of the propulsion unit power can be controllable by operator inputs via the power control arrangement 33, as might be desirable for operation in the first control mode to troll at an angle to a strong current or wind.

In a method of operating a watercraft 21 according to an aspect of the present invention, wherein the watercraft comprises at least two, independently turnable propulsion units 25 carried by the hull 27 of the watercraft, the watercraft is operated in a first control mode in which turning of two of the propulsion units is limited to turning through less than the entire range of motion of the two propulsion units, in equal amounts, and in opposite directions relative to the longitudinal centerline CL of the watercraft. In another step of the method, the watercraft 21 is operated in a second control mode different from the first control mode. In the second control mode, the watercraft can be operated entirely by operator input, for example, or entirely under the control of a control system such as the overall control system 35.

When the watercraft 21 is operated in the first control mode, an operator control such as the ability of an operator to control the positioning of the propulsion units 25 at all, or at least beyond the limited range of motion possible in the first control mode, and/or the ability of the operator to control the thrust generated by the propulsion units, can be deactivated. Operation of the watercraft in one of the first and second modes can be activated upon receipt of an input signal from an operator, such as by an operator turning a switch or knob, pressing a button, or maneuvering operator controls 29 for turning the propulsion units in a predetermined manner.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A watercraft with a control system, comprising:

at least two propulsion units carried by a hull of the watercraft, each propulsion unit being independently turnable;

a control system arranged to control orientation of the propulsion units, the control system including a first control mode in which turning of two of the propulsion units is limited to turning through less than an entire range of motion of the two propulsion units, in equal amounts, and in opposite directions relative to a longitudinal centerline of the watercraft; and operator controls for controlling turning of the propulsion units at least when the control system is not switched to first control mode, the control system being arranged such that, when the control system is in the first control mode, the operator controls for controlling turning of the propulsion units are deactivated.

2. The watercraft as set forth in claim 1, comprising an operator control for switching the control system to the first control mode from another operating mode different from the first control mode.

3. The watercraft as set forth in claim 1, comprising an operator control for switching the control system from the first control mode to another operating mode different from the first control mode.

4. The watercraft as set forth in claim 3, wherein, upon receipt of a first input signal from the operator control, the control system switches from the first control mode to another operating mode.

5. The watercraft as set forth in claim 4, wherein, upon receipt of the first input signal from the operator control, the control system is arranged to switch to a manual control mode in which turning of the propulsion units is controlled via operator input.

6. The watercraft as set forth in claim 5, wherein, upon receipt of a second input signal from the operator control, the control system is arranged to switch to an automatic control mode in which turning of the propulsion units is controlled by the control system.

7. The watercraft as set forth in claim 1, wherein turning of the propulsion units is limited to about ±5° from the longitudinal centerline of the watercraft when the control system is in the first control mode.

8. The watercraft as set forth in claim 1, comprising a power control arrangement permitting independent operator control of propulsion unit power.

9. The watercraft as set forth in claim 1, wherein, when the control system is in the first control mode, the control system prevents operator control of the propulsion unit power.

10. A watercraft with a control system, comprising:

at least two propulsion units carried by a hull of the watercraft, each propulsion unit being independently turnable;

a control system arranged to control orientation of the propulsion units, the control system including a first control mode in which turning of two of the propulsion units is limited to turning through less than an entire range of motion of the two propulsion units, in equal amounts, and in opposite directions relative to a longitudinal centerline of the watercraft; and an operator control for switching the control system from the first control mode to another operating mode different from the first control mode, wherein, upon receipt of a first input signal from the operator control, the control system switches from the first control mode to another operating mode, and wherein, upon receipt of the first input signal from the operator control, the control system is arranged to switch to an automatic control mode in which turning of the propulsion units is controlled by the control system.

11. A method of operating a watercraft, the watercraft comprising at least two, independently turnable propulsion units carried by a hull of the watercraft, comprising:

operating the watercraft in a first control mode in which turning of two of the propulsion units is limited to turning through less than an entire range of motion of the two propulsion units, in equal amounts, and in opposite directions relative to a longitudinal centerline of the watercraft;

operating the watercraft in a second control mode different from the first control mode;

operating the watercraft by operator input in the second control mode; and deactivating at least one operator control when operating the watercraft in the first control mode.

12. The method as set forth in claim 11, comprising operating the watercraft automatically under control of the control system in the first control mode.

13. The method as set forth in claim 11, comprising switching between operation of the watercraft in the first and second modes upon receipt of an input signal.

14. The method as set forth in claim 11, comprising changing turning of the propulsion units using operator controls during operation in the first control mode.

15. The method as set forth in claim 11, comprising preventing changing of turning of the propulsion units using operator controls during operation in the first control mode.

* * * * *